United States Patent [19]

Hong et al.

[11] Patent Number: 4,794,901

[45] Date of Patent: Jan. 3, 1989

[54] LOW PRESSURE AIR ASSISTED FUEL INJECTION APPARATUS FOR ENGINE

[75] Inventors: Rong-Fang Hong; Huei-Huay Huang, both of Hsin Chu Hsien, Taiwan

[73] Assignee: Industrial Technology Research Institute, Hsin Chu Hsien, Taiwan

[21] Appl. No.: 62,601

[22] Filed: Jun. 16, 1987

[51] Int. Cl.[4] ..... F02M 23/00

[52] U.S. Cl. ..... 123/533; 123/73 C

[58] Field of Search ..... 123/531, 533, 447, 472, 123/73 C; 239/87, 91

[56] References Cited

U.S. PATENT DOCUMENTS

| | | | |
|---|---|---|---|
| 2,291,594 | 7/1942 | Phillips | 123/533 |
| 3,707,143 | 12/1972 | Reese et al. | 123/73 C X |
| 4,543,939 | 10/1985 | Ehrhart et al. | 123/533 |
| 4,556,037 | 12/1985 | Wisdom | 123/533 X |
| 4,628,888 | 12/1986 | Duret | 123/533 X |
| 4,690,118 | 9/1987 | Hofbauer et al. | 123/472 X |
| 4,693,420 | 9/1987 | Klomp | 123/447 X |

*Primary Examiner*—Willis R. Wolfe

*Attorney, Agent, or Firm*—Cushman, Darby & Cushman

[57] ABSTRACT

It is a fuel injection apparatus using low pressure compressed air to assist the atomization of the fuel. It comprises a compressed air source, a circulating fuel circuit, a fuel solenoid valve, an air solenoid valve, a fuel-and-air mixing fixture, atomized-fuel passage and nozzles.

6 Claims, 6 Drawing Sheets

LOW PRESSURE AIR ASSISTED FUEL INJECTION APPARATUS FOR ENGINE

BACKGROUND OF THE INVENTION

In the current fuel injection apparatus for an engine to be controlled either with mechanical or electronic control device, the injection method is by means of fuel pump to generate a pressure in the fuel supplying line; then, the fuel is sprayed out of a nozzle, and hit with the external air to become small particles. If a better atomization condition of the fuel is required, the only way is to increase the pressure of the fuel so as to increase the injection speed of the fuel; however, to increase the injection pressure would increase the manufacturing cost. In the current commercialized fuel injection apparatus, such as the port injection type or the throttle body injection type, the fuel-feeding pressure is ranging from 1 kg/cm$^2$–3 kg/cm$^2$. In that low pressure region, the atomization condition of the fuel is far from being satisfactory; particularly in a two-stroke engine, it is rather difficult to reach a well condition under that low injection pressure because of the mixing time thereof being too short.

SUMMARY OF THE INVENTION

In view of the aforesaid drawbacks of the conventional fuel injection apparatus, the inventor has developed the present invention, in which a small amount of compressed air is used to assist the fuel injection and atomization; in other words, the liquid fuel is not sprayed into the engine directly, but it is blowed with air at a considerable high velocity, i.e., a mixture of the air and fuel being sprayed out. The air can generate a very high flowing velocity through a small passage upon being compressed slightly, and that high velocity flowing air can atomize the fuel into very fine particles. The present invention can be used in a two-stroke or a four-stroke engine for elevating the combustion efficiency greatly; particularly, when the present invention is used in a two-stroke engine, fuel consumption can greatly be reduced, and the air pollution can also be improved. The structure, features and the functions of the present invention are described, with reference to the accompanying drawings, in detail in the following.

DETAILED DESCRIPTION

Figure 1:
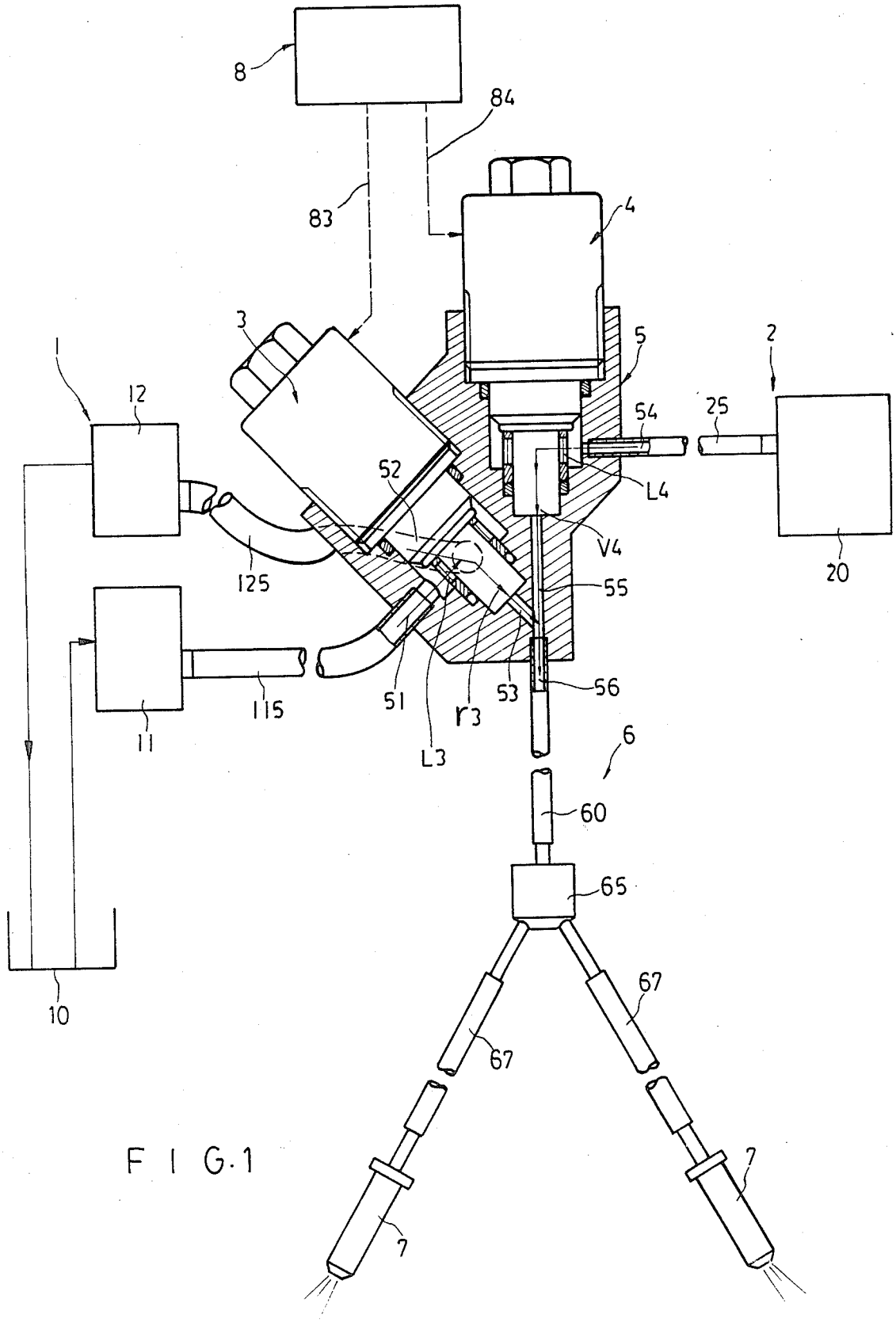
FIG. 1 is a schematic view of the embodiment of the compressed air assisted fuel injection apparatus according to the present invention.

FIG. 1 illustrates an embodiment of the air-assisted fuel injection apparatus of the present invention, which comprises a fuel circuit 1, a compressed air source 2, two solenoid valves 3 and 4, a fuel-and-air mixing fixture 5, atomized-fuel passage 6, nozzles 7, and an electronic control unit 8, etc. The aforesaid parts are described respectively as follows:

The fuel circuit 1 provides a suitable fuel pressure so as to facilitate the solenoid valve 3 to control the injection quantity (mg/cycle) of the fuel. The pressured fuel from the fuel pump flows through pipe 115 and the fuel inlet 51 of the fuel-and-air mixing fixture 5 to the valve port $V_3$ of the solenoid valve 3. Upon the valve port V being opened, the fuel will be injected through the fuel passage 53. On idling, the fuel flows through the fuel returning passage 52 of the fuel-and-air mixing fixture 5, the pipe 125 and the pressure regulating valve 12 to flow back into the fuel tank 10. The fuel pump 11 may be of an ordinary electric motor type that can provide a pressure up to 1 kg/cm$^2$. The pressure regulating valve 12 is an ordinary two-way valve for regulating the pressure in the fuel circuit 1. The circulation of the fuel maintains its constant pressure at the valve port $V_3$ and makes it cooled down to be prevented from having bubbles.

The compressed air source 2 includes an air compressor 20; the air flows, via the pipe 25, the air inlet 54, to the valve port $V_4$ of the solenoid valve 4; upon the valve port $V_4$ being opened, a high velocity of air stream will be injetted into the air passage 55 to mix with the fuel injected through the fuel passage 53; then, the mixture will be jetted out of the mixture passage 56.

The air compressor 20 may be of an ordinary reciprocating piston type, which is to be driven by the engine or an electric motor to maintain at a suitable pressure ranging about 2 kg/cm$^2$ to 3 kg/cm$^2$. The volume of the compressed air to be injected is hinged on the volume of fuel to be atomized, i.e. it is related to the engine displacement. Generally, if an engine can consume a fuel of 10 mg/cycle during its maximum load of output, it will require 1 c.c. of air to have that amount of fuel fully atomized.

Figure 2:
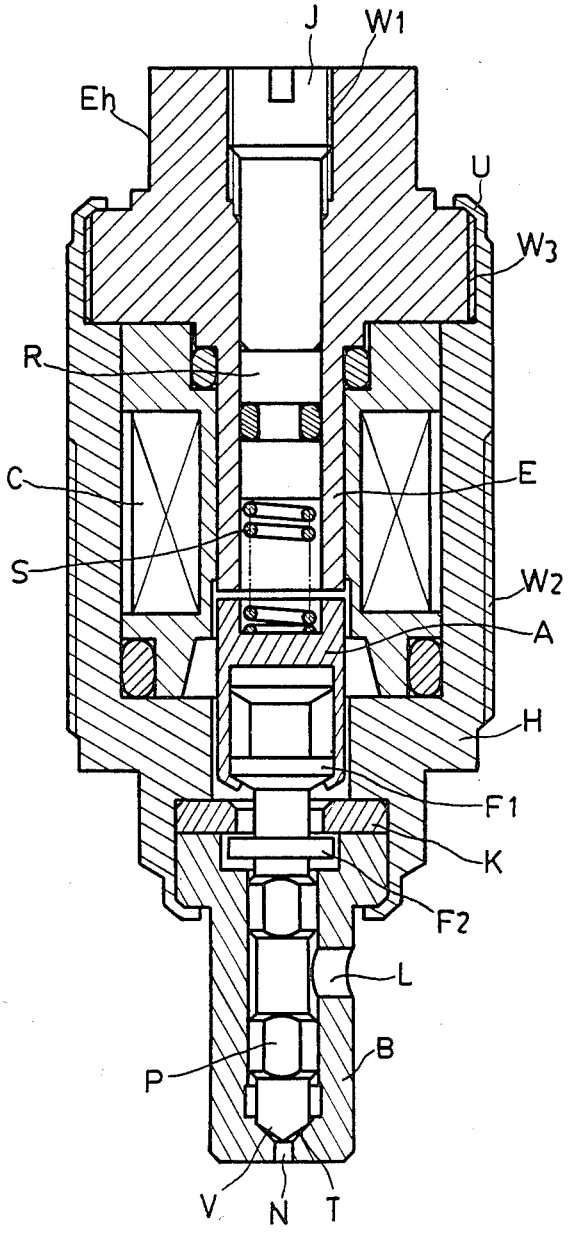
FIG. 2 is a sectional view of the solenoid value of the present invention.
Figure 3:
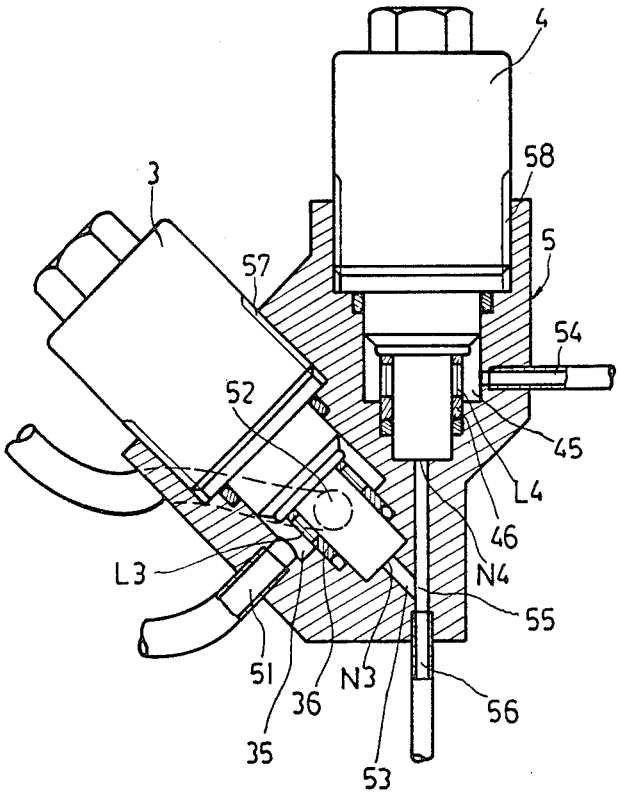
FIG. 3 is a sectional view of the fuel-and-air mixing fixture of the present invention.

The function of the fuel solenoid valve 3 and the air solenoid valve 4 is for accurately controlling the fuel volume of each combustion of the engine; the both aforesaid valves may have the same structure as shown in FIG. 2. Basically, it is a solenoid valve with an orifice N having a fixed diameter. Upon the coil C being energized, a magnetic field will exist between the core stator E and the armature A, and the armature A will be attracted by the core stator E. Since the armature A and the flange $F_1$ of the valve pin P are pressed into one unit, the valve pin P will be attracted to move upwards from the valve seat T until being stopped as the round flange $F_2$ being caught by the gasket K; in that case, the valve pin P and the valve seat T form a valve port V with a given size so as to let the fuel or air pass through the valve port V and the orifice N to jet outwards. Upon the coil C being de-energized, the magnetic field between the core stator E and the armature A disappears; the spring S will push the valve pin P back to the valve seat T to stop the jetting of fuel or air. The pressure of the spring S applied to the armature A may be regulated by rotating a screw J in the threaded portion $W_1$ between the scew J and the core stator E so as to adjust the kinetic reaction of the valve pin P. Each of the solenoid valve has an outer housing H for mounting the aforesaid parts. The outer housings H are furnished with a threaded portions $W_2$ so as to have the outer housings H screwed fixedly in the threaded holes 57 and 58 respectively as shown in FIG. 3. Since the core stator E, the armature A and the outer housing H are the parts to form the magnetic circuit, they are made of soft magnetic material with high magnetic conductivity. The core stator E and the outer housing H are assembled together by means of the threaded portion $W_3$, and are fixed in place by pressing the shoulder U of the outer housing H to cover on the core stator E. The top portion Eh of the core stator E is formed into hexagonal shape so as to facilitate the solenoid valves 3 and 4 to assemble or disassemble from the fuel-and-air mixing fixture 5.

Figure 5:
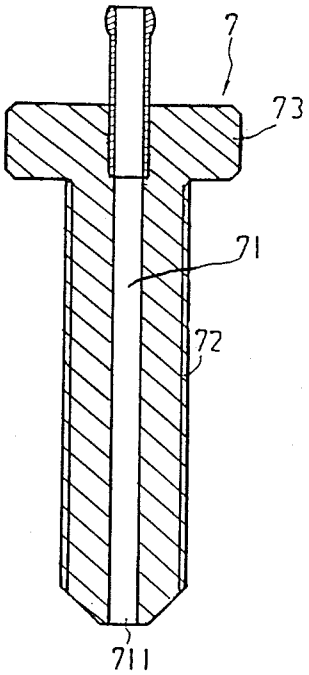
FIG. 5 is a sectional view of the second embodiment of the nozzle according to the present invention.
Figure 4:
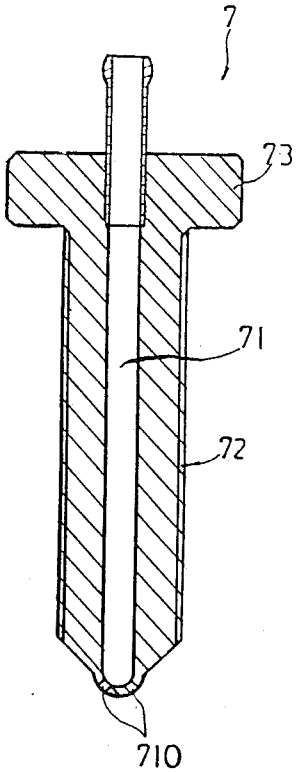
FIG. 4 is a sectional view of the first embodiment of the nozzle according to the present invention.
Figure 8:
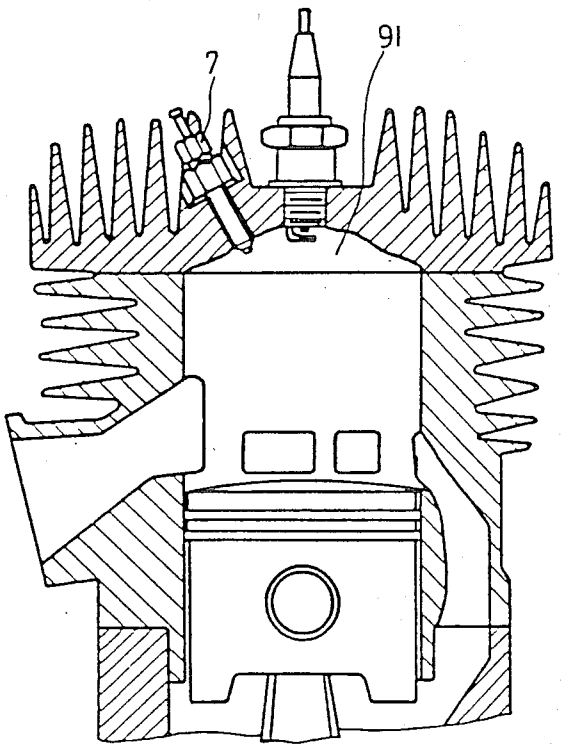
FIG. 8 is a sectional view of a two-stroke engine, showing the nozzle of the present invention mounted on the cylinder head.
Figure 6:
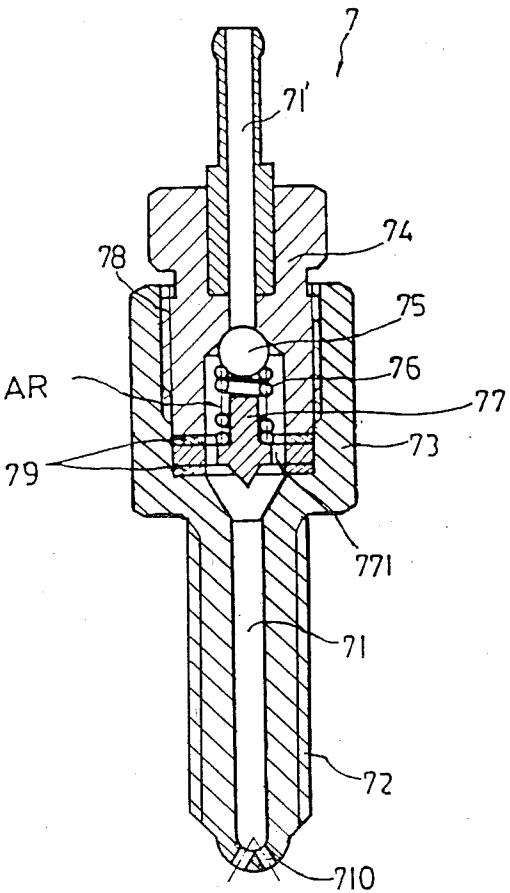
FIG. 6 is a sectional view of the third embodiment of the nozzle according to the present invention.
Figure 10:
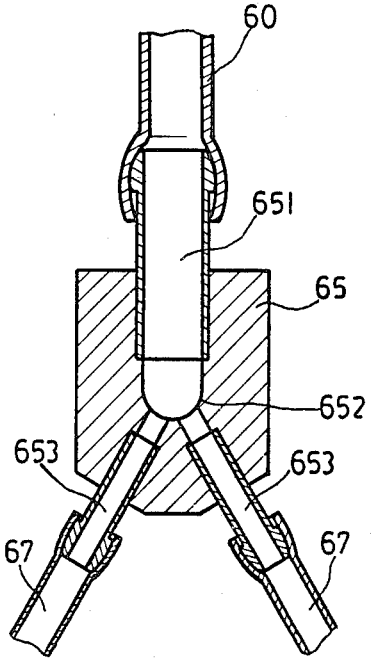
FIG. 10 is a sectional view of the mixture distributing block according to the present invention.
Figure 9:
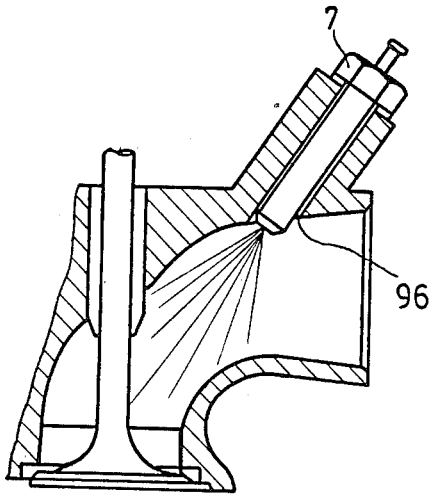
FIG. 9 is a sectional view of the inlet value portion of a four-stroke engine, showing the nozzle of the present invention mounted thereon.

FIG. 3 illustrates the fuel-and-air mixing fixture 5 having two threaded holes 57 and 58 for mounting the fuel solenoid valve 3 and the air solenoid valve 4 respectively so as to have the orifices $N_3$ and $N_4$ of the valves 3 and 4 connected with the fuel passage 53 and the air passage 55 respectively. The two passages 53 and 55 are intersected at a suitable angle and led to a mixture passage 56 which is better be straightly extended from the air passage 55. In the connecting portions between the solenoid valves 3 and 4 and the fuel-and-air mixing fixture 5, there form two collar-shaped spaces 35 and 45 respectively; the collar-shaped spaces 35 is in communication with the fuel inlet 51 and the fuel returning passage 52, the collar-shaped space 45 is in communication with the air inlet 54; thus, the pressured fuel and the compressed air can be fulfilled in the collar-shaped spaces 35 and 45 respectively, and can flow through the collar-shaped filters 36 and 46 respectively to enter into the inlets $L_3$ and $L_4$ of the solenoid valves 3 and 4 respectively for jetting out. The fuel is jetted into the fuel passage 53 earlier than the air jetted into the air passage 55 to have the fuel and air mixed. As shown in FIG. 1, the mixture of fuel and air in an atomized manner flows out through the mixture passage 56, via a conveying pipe 60, a mixture distributing block 65, to several branch pipes 67 and nozzles 7; the aforesaid parts 60, 65, 67 is designated as the atomized fuel passage 6. The first, second and third embodiments of the nozzle 7 are shown in FIGS. 4 and 5 and 6 respectively. The nozzle 7 body is formed into a round stem with threads 72 on the outer surface thereof so as to be screwed into a cylinder or an intake manifold of an engine as shown in FIGS. 8, 9 and 10. The top of the nozzle is furnished with a hexagonal portion 73 to facilitate its assembling or disassembling operation; the center of the nozzle 7 is furnished with a passage 71, which is to be connected with the atomized-fuel passage 6. The lower end of the nozzle 7 may be furnished with a multi-spraying orifices 710 for a wider angle spraying as shown in FIGS. 4 and 6, or a single-spraying orifice 711 for a small angle spraying as shown in FIG. 5.

In the middle portion of the passage 71, there is a check valve AR, which comprises a body portion 74, a steel ball 75, a spring 76, and a base 77. The body portion 74 also forms the upper portion of the nozzle. The body portion 74 is mounted in the lower portion of the nozzle by means of threads 78 and the gasket 79. The fuel gas in the upper passage 71' would push the steel ball 75 downwards, and pass through the spring chamber and the hole 771 on the base 77 to enter into the passage 71, spraying out of the spraying hole 710. Any external force would cause the valve to be closed without resulting in a reversely flowing.

The function of the electronic control unit 8 is to control the timing of the solenoid valves 3 and 4, i.e., their opening and closing sequence and the time periods of that opening or closing. When the electronic control unit 8 receives the data fed back through the sensors from the various related parts of the engine, such as the position of the throttle plate, the rpm of the engine, and the volume of intake air, etc., those data will be converted into a pulse signal to energize, through the circuits 83 and 84, the two valves 3 and 4 respectively. The spraying volume is hinged on the width of the pulse signal that controls solenoid. The time when the atomized fuel is injected is hinged on the moment the pulse signal to energize the air solenoid valve.

Figure 7:
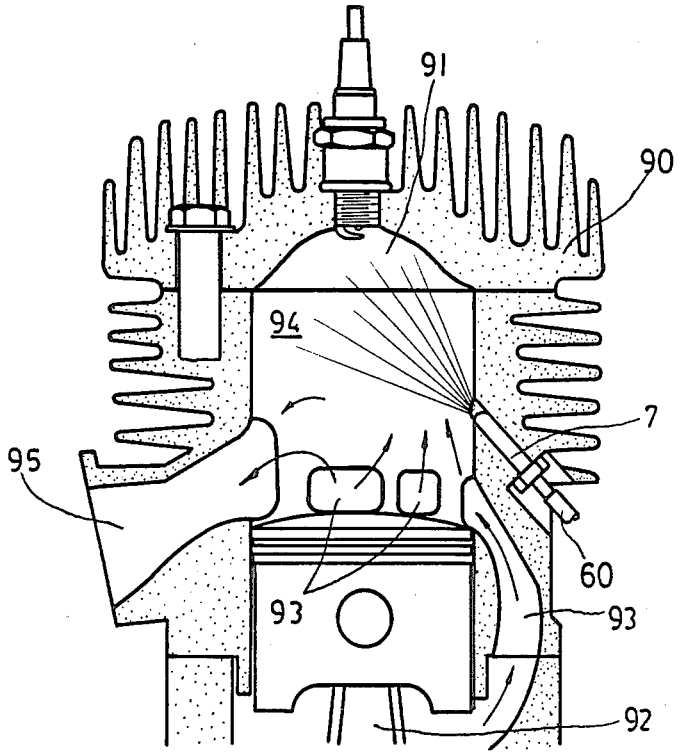
FIG. 7 is a sectional view of a two-stroke engine, showing the nozzle of the present invention mounted on the cylinder.

FIG. 7 illustrates the apparatus according to the present invention being used in a two-stroke engine, in which the nozzle 7 with a wide-spraying angle is mounted on the cylinder 90 to spray towards the cylinder head 91. Before the fuel being sprayed in, a clean air stream for scavenging the waste gas flows into the combustion chamber 94 from the crank case 92 via the various scavenging passages 93; in other words, any waste gas in the cylinder will be driven out with clean and pure air instead of using the pre-mixed gas (fuel and air) to do that as in the conventional engine with a carburetor. In the conventional engine, the aforesaid pre-mixed gas is to be exhausted out of the exhausting port 95 without combustion. According to the present invention, the air pollution can be reduced, and the fuel can be saved. Since the fuel is fully atomized, it can be well mixed and burned with the air in the cylinder, the combustion efficiency has highly been increased. The nozzle can withstand high temperature, and high pressure, and therefore the possibility of deposition of carbon and other impurities around the orifice can be reduced considerably so as to maintain the injection apparatus in a stable operation manner.

FIG. 8 illustrates the apparatus being used in a two-stroke engine; in that case, the nozzle 7 is mounted on the cylinder head 91 so as to have the jetting operation not limited by the stroke motion of the piston, and to avoid carbon-depositing pollution to the nozzle upon the same being mounted on the cylinder wall; however, the nozzle 7 is subject to high temperature pressure of the cylinder during the initial exploding period, and therefore a one-way nozzle is used as shown in FIG. 6.

FIG. 9 illustrates the system according to the present invention being mounted outside a four-stroke engine, in which the nozzle 7 is mounted a suitable position on the intake passage 96. Since the fuel has fully been atomized, the engine can have a high combustion efficiency.

When the systems of the present invention is used with a single-cylinder engine, the conveying pipe 60 as shown in FIG. 1 may be connected directly with the single nozzle 7. Upon the system of the present invention being used in a multi-cylinder engine, the conveying pipe 60 is first connected with a mixture distributing block 65 and several branch pipes 67 and nozzles 7 mounted in place respectively.

FIG. 10 is sectional view of the mixture distributing block 65, in which the inner diameter of the mixture inlet tube 651 is the same as that of the conveying pipe 60. The inner end 652 of the mixture inlet tube 651 is formed into a ball-shape surface. The outlet tubes 653 connected with the branch pipes 67 respectively are mounted on the inner end 652 at a regular angle each other. The sum of the inner sectional areas of the outlet tubes 653 should be equal to the sectional area of the mixture inlet tube 651; the inner diameters of the nozzle 7 connected to the branch pipe 67 are also equal to the inner diameters of the branch pipe 67 respectively so as to maintain the mixture under a stable pressure to prevent the mixture from condensing into bigger particles.

Briefly, the injection apparatus for providing a mixture of compressed air and fuel according to the present invention can be used either with a two-stroke engine or a four-stroke engine for increasing the combustion efficiency, lowering the fuel consumption rate, and lowering the air pollution; therefore, it possesses practical value.

We claim:

1. A low pressure compressed air assisted fuel injection apparatus for a gasoline engine comprising:

a compressed air source including an air compressor for providing compressed air at a predetermined pressure; and a circulating fuel circuit including an electric fuel pump and a pressure regulating valve for providing fuel at a stable pressure therein;

a fuel solenoid valve connected to said fuel circuit and a single air solenoid valve connected to said compressed air source, said fuel solenoid valve and said air solenoid valve being used to control said fuel and said compressed air, respectively, so that said fuel and said compressed air are jetted from orifices of said fuel and air solenoid valves respectively in adequate quantity and timing according to a command generated from an electronic control unit, said fuel and air solenoid valves being fixedly mounted on a fuel-and-air mixing fixture that has an air passage and a fuel passage, the jetted air and the jetted fuel being injected into and mixed with one another in a mixture passage, said fuel and air mixture then passing through an automized-fuel passage and being transferred to a nozzle mounted at a suitable position of the engine, said fuel and air mixture being finally sprayed into said engine.

2. An apparatus as claimed in claim 1, wherein said atomized-fuel passage includes a mixture distributing block to distribute atomized fuel to various cylinders equally, said mixture distributing block having an inlet tube being connected to the mixture passage of said fuel-and-air mixing fixture, and several outlet tubes being connected with several nozzles respectively, said several outlet tubes being positioned on the inner end of the mixture inlet tube at an equal angle in relation to the axis of said inlet tube; and in said atomized-fuel passage, from said mixture passage of said fuel-and-air mixing fixture to said various nozzles, the inner sectional areas being substantially the same so as to maintain the mixture at a suitable pressure.

3. An apparatus as claimed in claim 1, wherein said nozzle is to be mounted on an engine for in-cylinder injection; and the front end of said nozzle is provided with a plurality of spraying orifices arranged specifically so as to provide a desired spraying condition.

4. An apparatus as claimed in claim 3, wherein the nozzle includes a check valve structure mounted in an inner passage of said nozzle, said check valve structure including a steel ball and a spring for keeping the valve normally closed, said valve being disposed so that it is in a closed position when no fuel is present in the nozzle and opened when pushed by fuel in the nozzle, any external reverse pressure causing said valve to return to the closed position.

5. An apparatus as in claim 1, wherein said gasoline engine is a two stroke engine and said nozzle is disposed on a cylinder of said engine.

6. An apparatus as claimed in claim 5 wherein said fuel passage and said air passage in said fuel-and-air mixing fixture intersect at a predetermined angle; said fuel and air injections into said mixture passage being timed so that after said fuel solenoid valve opens to inject the fuel into said mixture passage, said air solenoid valve begins to inject the compressed air to move the fuel through said mixture passage and atomize the fuel.

* * * * *